US007175466B2

(12) United States Patent
Feinweber et al.

(10) Patent No.: US 7,175,466 B2
(45) Date of Patent: Feb. 13, 2007

(54) PLUG

(75) Inventors: Cristina Feinweber, Eriensee (DE); Gabriel Hotea, Offenbach (DE); Hartmut Ripper, Darmstadt (DE); Mile Trajkov, Frankfurt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 104 days.

(21) Appl. No.: 11/064,160

(22) Filed: Feb. 23, 2005

(65) Prior Publication Data

US 2005/0286836 A1 Dec. 29, 2005

(30) Foreign Application Priority Data

Feb. 23, 2004 (DE) ..... 10 2004 008 712

(51) Int. Cl.
*H01R 13/627* (2006.01)

(52) U.S. Cl. ..... 439/357

(58) Field of Classification Search ..... 439/352, 439/489, 582, 701, 357, 466
See application file for complete search history.

(56) References Cited

U.S. PATENT DOCUMENTS

| | | | | |
|---|---|---|---|---|
| 5,653,606 | A * | 8/1997 | Chrysostomou | 439/352 |
| 5,895,282 | A * | 4/1999 | Little | 439/332 |
| 5,924,885 | A * | 7/1999 | Pacher | 439/352 |
| 5,993,230 | A * | 11/1999 | Gauker et al. | 439/188 |
| 6,193,530 | B1 * | 2/2001 | Sakurai et al. | 439/157 |
| 6,361,348 | B1 * | 3/2002 | Hall et al. | 439/352 |
| 6,491,542 | B1 * | 12/2002 | Zerebilov | 439/489 |
| 6,699,059 | B2 * | 3/2004 | Nagamine et al. | 439/352 |
| 6,705,886 | B1 * | 3/2004 | Brown | 439/489 |
| 6,811,424 | B2 * | 11/2004 | Seminara et al. | 439/352 |
| 6,910,902 | B2 * | 6/2005 | Osada | 439/188 |
| 6,945,801 | B2 * | 9/2005 | Brown | 439/188 |
| 6,964,579 | B2 * | 11/2005 | Seminara et al. | 439/352 |
| 6,986,665 | B2 * | 1/2006 | Schauz et al. | 439/21 |
| 7,004,778 | B2 * | 2/2006 | Barker et al. | 439/352 |
| 2001/0051023 | A1 | 12/2001 | Shirakawa et al. | |
| 2006/0084314 | A1 * | 4/2006 | Takizawa | 439/352 |

FOREIGN PATENT DOCUMENTS

| | | | |
|---|---|---|---|
| DE | 29521387 | U1 | 2/1997 |
| DE | 295 21 387 | U1 | 4/1997 |
| DE | 199 42 921 | C2 | 9/2001 |
| EP | 1365484 | A1 | 11/2003 |

* cited by examiner

*Primary Examiner*—Tulsidas C. Patel
*Assistant Examiner*—PhuongChi Nguyen
(74) *Attorney, Agent, or Firm*—Barley Snyder LLC

(57) ABSTRACT

The present invention relates to a plug comprising a main housing, at least one conductor guide and a supplementary part. To improve the plug such that the conductor guide can be assembled as easily as possible and its correct position easily checked, with the conductor guide still being well secured, the conductor guide comprises a retaining profile with which a partial profile of the main housing and a supplementary profile of the supplementary part can be brought, at least in certain sections, into engagement so as to correspond with each other. The supplementary part can be moved relative to the main housing between a starting position and a closed position, and in the starting position the conductor guide can be positioned in an opening formed with the partial profile and the supplementary profile and is axially loosely movable and in the closed position is rotatably and axially fixed relative to the main housing and the supplementary part owing to the engagement of the holding profile with the partial profile and the supplementary profile.

13 Claims, 7 Drawing Sheets

PLUG

FIELD OF THE INVENTION

The present invention relates to a plug connector comprising a main housing, at least one conductor guide and a supplementary part.

BACKGROUND

A plug connector is known from US 2001/0051023 A1 in which a bushing, enclosing one end of a conductor, with a radially outwardly projecting collar is provided as a conductor guide. The bushing is introduced into a plug housing hole with a radially inwardly projecting collar. On introduction, the collar of the bushing comes into contact with the collar of the plug housing hole and latches with a latching profile of the housing. The bushing is thus already axially fixed when inserted into the housing and can accordingly additionally be secured using a laterally inserted contact securing device as a supplementary part.

Accordingly, an object of the present invention is to improve a plug connector comprising a main housing, at least one conductor guide and a supplementary part in such a way that the conductor guide can be easily introduced and yet reliably axially secured, wherein it should be possible to easily assemble the plug connector.

SUMMARY

The object is achieved according to the invention by a plug connector comprising a main housing, at least one conductor guide and a supplementary part. To improve the plug connector such that the conductor guide can be assembled as easily as possible and its correct position easily checked, with the conductor guide still being well secured, the conductor guide comprises a retaining profile with which a partial profile of the main housing and a supplementary profile of the supplementary part can be brought, at least in certain sections, into engagement so as to correspond with each other. The supplementary part can be moved relative to the main housing between a starting position and a closed position, and in the starting position the conductor guide can be positioned in an opening formed with the partial profile and the supplementary profile and is axially loosely movable and in the closed position is axially fixed relative to the main housing and the supplementary part owing to the engagement of the holding profile with the partial profile and the supplementary profile.

The conductor guide can initially be introduced axially and radially relatively loosely into the main housing. Only if axial fixing of the conductor guide is intended is the conductor guide brought into an axial position in which its retaining profile can engage with the main housing profile and the supplementary part profile. The supplementary part is then moved into its closed position. Even then the conductor guide can still be rotated and can subsequently be brought into a desired position of rotation.

In a particularly advantageous embodiment of the invention the supplementary part can, in the closed position, latch with the main housing. The supplementary part is thus secured in its closed position whereby the axially fixed state of the conductor guide is also secured.

The supplementary part can advantageously be movably guided on the main housing, via guide rails, between the starting position and the closed position. With a defined movement, the supplementary part can be brought between the starting position and the closed position hereby.

Mutually corresponding latching structures can in each case be provided on the main housing and the supplementary part, preferably substantially in the region of the guide rails. The latching structures are therefore positioned in a region in which the main housing and the supplementary part can be brought into engagement with each other. Latching resistances are therefore generated in the vicinity of the guide rails whereby latching and unlatching of the guide rails takes place with little jamming.

A latching mechanism can advantageously be provided with an actuating rocker with which the plug can be latched to a mating plug, a latching profile of the latching mechanism and the actuating rocker being constructed for this purpose on the supplementary part. A plurality of functions are combined in the supplementary part thereby, in particular proportional axial fixing of the conductor guide and latching of the plug to the mating plug. The plug can be latched to the mating plug when the supplementary part is assembled on the plug.

A rocker support of the actuating rocker can particularly advantageously be provided on the main housing, the rocker support defining a rocker axis of the actuating rocker. The latching mechanism is hereby formed by the main housing and the supplementary part together and the rocker mechanism is dependent on the formation of the rocker support on the main housing.

In the closed position of the supplementary part, the actuating rocker can preferably be in contact with the rocker support, while in the starting position of the supplementary part, the actuating rocker is at a spacing from the rocker support. The actuating rocker can thus execute a rocking movement defined by the rocker support in the closed position of the supplementary part.

The actuating rocker can advantageously be connected at one side in the region of the latching profile to a retaining arm of the latching profile, the retaining arm being provided on the supplementary part at one side at an end opposing the latching profile. Movement of the latching profile is thus associated with movement of one end of the actuating rocker, the latching profile being moved with one end of the retaining arm.

The retaining arm can advantageously be resiliently deformable, while the actuating rocker is comparatively resistant to bending. There is thus a division of functions between the actuating rocker and the retaining arm. While the rocker remains relatively stiff and determines the path of the latching profile, the retaining arm applies resilient restoring forces.

In the closed position of the supplementary part, an actuating portion of the actuating rocker can preferably be arranged in the region of the end at which the conductor guide issues from the main housing. The actuating portion is thus located in a region of the plug connector at which it can be easily reached and therefore easily operated.

In a development of the invention at least one rotatable fixing device can be provided on the main housing and/or the supplementary part, with which device the conductor guide can be locked in a specific position of rotation. The conductor guide, despite its capacity to rotate with axial fixing, can also be locked hereby in a specific position of rotation.

The rotatable fixing device can preferably be moved between a release position in which the conductor guide can be rotated relative to the main housing, and a locking position in which the conductor guide is locked in the specific position of rotation. The conductor guide can thus be rotated or locked in the specific position of rotation as required.

A part of the rotatable fixing device which can be brought into engagement with the conductor guide can advantageously be constructed substantially in the manner of a fork. The conductor guide can, at least in certain sections, be well encompassed by this part.

BRIEF DESCRIPTION OF THE DRAWING FIGURES

Embodiments of the invention are illustrated in the drawings and will be described hereinafter. In the drawings:

FIG. 1 shows a plug connector according to an exemplary embodiment of the invention in an assembled state, FIG. 2 shows a main housing and a supplementary part of the plug connector of FIG. 1 in a separated state, FIG. 3 shows the main housing and the supplementary part of the plug connector of FIG. 1 in a preassembled state in which the supplementary part is in a starting position, FIG. 4 is a sectional view of the plug connector of FIG. 1, wherein the supplementary part is in the starting position, FIG. 5 is a sectional view of the plug connector of FIG. 1, wherein the supplementary part is in a closed position, FIG. 6 is a sectional view of the plug connector of FIG. 1, wherein the plug connector is pushed onto a mating plug connector and is latched therewith, FIG. 7 is a perspective view of the plug connector and the mating plug connector of FIG. 6, FIG. 8 shows a double plug connector with two conductor guides according to another exemplary embodiment of the invention, FIG. 9 shows a main housing and a supplementary part of the double plug connector of FIG. 8 in a separated state, FIG. 10 shows the main housing and the supplementary part of the double plug connector of FIG. 8, in a preassembled state, the supplementary part being in a starting position, FIG. 11 is a side view of a plug connector according to yet another exemplary embodiment of the invention, FIG. 12 is a view of the back of the plug connector in FIG. 11, FIG. 13 is a side view of the plug connector of FIG. 11 but with a rotatable fixing device in a locked position and FIG. 14 is a view of the back of the plug connector of FIG. 13.

DETAILED DESCRIPTION OF THE EMBODIMENT(S)

As shown in FIG. 1, according to an exemplary embodiment of the invention, a plug connector 1 is provided comprising a main housing 2, a supplementary part 3 and a conductor guide 4. The supplementary part 3 is constructed so as to correspond with the main housing 2 to form a housing assembly. In a closed position, the supplementary part 3 is inserted in the main housing 2. In the closed position, a retaining profile of the conductor guide 4 is correspondingly engaged with a profile of the main housing 2 and a supplementary profile of the supplementary part 3. In this state, the conductor guide 4 is fixed to the housing assembly comprising the main housing 2 and the supplementary part 3 so as to be rotatable about a terminal contact axis 8, and the conductor guide 4 is axially aligned to the terminal contact axis. The rotatability of the conductor guide 4 about the terminal contact axis 8 is indicated by an arrow 9.

The housing assembly comprising the main housing 2 and the supplementary part 3 comprises a latching mechanism 10 with which the plug connector 1 can be latched to a mating plug connector.

FIG. 2 shows the main housing 2 and the supplementary part 3 in a separated state. The main housing 2 comprises in its interior, a receiving space 12 open toward a base 38 of the main housing. An upper wall 13 of the main housing 2 has formed therein a hole 14 in communication with the receiving space 12. A partial circumferential contour of the hole 14 is formed as a the partial profile 6 on a back wall 15 of the main housing 2. The partial profile 6 is a circumferential face 16 substantially shaped like an arc of a circle with a collar 17 extending radially inwards therefrom. The collar 17 terminates with the upper side of the upper wall 13.

The main housing 2 comprises two side walls 18, 19 extending substantially parallel to each other, adjoining the back wall 15 and enclosing the interior receiving space 12. Guide rails 20, 21 are formed in the upper wall 13 substantially parallel to the side walls 18, 19 and issuing from the hole 14 and substantially at the axial height of the partial profile 6. The guide rails 20, 21 each have lower lying guide grooves 20, 23 at which guide springs 24, 25 are formed. Each guide spring 24, 25 projects inwards and terminates at the upper surface of the upper wall. The upper wall 13 is formed so as to be recessed in the region between the guide rails 20, 21, so there is free alignment between the guide rails 20, 21.

The supplementary part 3 can be moved substantially transversely to the terminal contact axis 8 through the indentation 40 and, guided by the guide rails 20, 21, between the closed position and a starting position.

As latching structures, the guide rails 20, 21 comprise latching indentations 27, 29 and latching recesses 28, 30 toward a receiving side 26 of the main housing opposing the back wall 15. The latching indentations 27, 29 are constructed in the manner of a notch at the level of the guide springs 24, 25. Outwardly stepped or set-back portions 31, 32 of the guide springs 24, 25 adjoin the latching indentations 27, 29 in a direction toward the receiving side 26. The respective ends 33, 34 of the guide springs 24, 25 are nose-shaped projections opposite the outwardly set-back portions 31, 32.

The latching recesses 28, 30 are constructed as window-like apertures in the side walls 18, 19 as an interruption to the guide grooves 22, 23 and are located substantially in the region of the outwardly set-back portions 31, 32.

At the receiving side 26, the main housing 2 comprises a supplementary part receiving indentation 35 which extends parallel to the terminal contact axis 8 and has a width which substantially corresponds to the spacing of the guide rails 20, 21 from each other. The base of the receiving groove 35 is formed by a receiving-side wall 36 of the main housing 2. The wall 36 comprises a recess 37 extending parallel to the terminal contact axis 8. The recess 37 is open toward the base 38 of the plug 2.

Extending transversely through the receiving groove 35 and limiting the recess 37 in the direction of the upper wall 13 is a web-like rocker support 39 constructed as a portion of the latching mechanism 10 on the wall 36. The wall 36 extends up to the upper wall 13 and merges into it.

The supplementary part 3 has an upper plate 41 on which a supplementary profile 7 is provided. Supplementary guide rails 42, 43 are formed on mutually parallel outer sides 76, 77 of the upper plate 41. A unit comprising a latching profile 44, a retaining arm 45 and an actuating rocker 46 is also provided on the supplementary part 3 as part of the latching mechanism 10. The retaining arm 45 is connected at one side to the upper plate 41 opposite to the supplementary profile 7. Said unit 44, 45, 46 is constructed in one piece with the upper plate 41.

The supplementary profile 7 is formed analogously to the partial profile 6 of the main housing 2 as a circumferential face 47 substantially shaped like an arc of a circle formed in the upper plate 41. Analogously to the partial profile 6, the supplementary profile 7 also has a collar 48 protruding radially inwardly with respect circumferential face 47. The collar 48 ends with an upper side 49 of the upper plate 41.

The supplementary guide rails 42, 43 are each constructed substantially stepped and with the latching structures, so as to correspond with the guide rails 20, 21 of the main housing 2. Respective upper stepped contours 50, 51 correspond to the guide springs 24, 25 of the main housing 2 and comprise latching projections 52, 53 which can slide with relatively little force in the region of the outwardly set-back portions 31, 32 and can be brought into latching engagement with the latching indentations 27, 29 of the main housing 2. Lower stepped contours 54, 55 of the supplementary guide rails 42, 43 correspond to the guide grooves 22, 23 of the main housing 2 and comprise latching projections 56, 57. These latching projections 56, 57 correspond to the latching recesses 28, 30 of the main housing 2 and can be brought into latching engagement therewith.

The retaining arm 45 of the latching profile 44 comprises two outer bending arms 58, 59 issuing from the upper plate 41 and which laterally delimit a swivelling space 60 of the actuating rocker 46. The latching profile 44 transversely connects the bending arms 58, 59 at the ends thereof opposite the upper plate 41. The retaining arm 45 is thus provided on the supplementary part 3 at one side at an end opposing the latching profile 44.

The plug connector 1 can be latched to a mating profile of the mating plug connector by the latching profile 44 when the supplementary part 3 is assembled on the main housing 2 and, in particular, is in the closed position. This prevents the plug connector 1 from being latched with the mating plug connector when assembly of the supplementary part 3 has been forgotten.

The actuating rocker 46 comprises two elongated rocker beams 63, 64 constructed so that they are resistant to bending in terms of their cross-section and which are each connected at one side thereof to the latching profile 44. The rocker beams 63, 64 extend parallel to each other. In comparison with the retaining arm 45, the actuating rocker 46 is thus resistant to bending whereas the retaining arm 45 can be easily resiliently deformed in comparison with the actuating rocker 46.

Opposite the latching profile 44 is moulded a key-like actuating portion 65 which transversely connects the rocker beams 63, 64. The actuating rocker 46 can swivel into the swivel space 60 at the actuating portion 65 causing the actuating rocker 46 (by interaction with the rocker support 39 and the stiffness of the actuating rocker 46) to swivel out in the region of the latching profile 44 that is connected to the resiliently deformable retaining arm 45.

FIG. 3 shows the main housing 2 and the supplementary part 3 in a pre-assembled state, the supplementary part 3 being in the starting position with respect to the main housing 2. To arrive at the preassembled state from the separated state of the supplementary part 3 and the main housing 2, shown in FIG. 2, the upper plate 41 of the supplementary part 3 is threaded into the main housing 2. The supplementary guide rails 42, 43 of the supplementary part 3 are brought into engagement with the guide rails 20, 21 of the main housing 2 in the process.

The supplementary part 3 is then inserted in the manner of a drawer, transversely to the terminal contour axis 8 of the main housing 2, into the main housing 2 in accordance with the movement path predetermined by the guide rails 20, 21 and the supplementary guide rails 42, 43. In the process, the latching projections 52, 53 of the upper stepped contours 50, 51 overcome the nose-shaped projecting ends 33, 34 of the guide springs 24, 25 and arrive in the region of the outwardly set-back portions 31, 32 of the guide rails 20, 21. The latching projections 56, 57 of the lower stepped contours 54, 55 are still disengaged from the guide grooves 22, 23 of the guide rails 20, 21 in this position of the supplementary part 3 and are therefore still spaced apart from the main housing 2.

In this starting position of the supplementary part 3, an opening 66 formed between the partial profile 6 and the supplementary profile 7 is so large that the retaining profile 5 of the conductor guide 4 can be axially inserted into this opening 66 and can be axially and radially loosely moved therein, cf. FIG. 4. The retaining profile 5 of the conductor guide 4 is accordingly disengaged from the partial profile 6 and the supplementary profile 7.

The actuating rocker 46 is also at a spacing from the rocker supporting part 39 of the main housing 2. On actuation the actuating rocker 46 would execute a different type of movement to a rocker movement determined by the rocker supporting part 39. The latching profile 44 is also spaced apart from the main housing 2 and cannot engage with the mating profile of the mating plug connector. This prevents the plug connector 1 from latching with the mating plug connector when the supplementary part is still in the starting position.

As can also be seen in FIG. 4, the conductor guide 4 is formed substantially at a right angle in this embodiment. A conductive element 68 is arranged in the interior 67 of the conductor guide 4 and is connected to a terminal contact 69 for connection to a corresponding mating contact. The conductive element 68 is initially guided transversely in the conductor guide 4, with respect to a longitudinal axis 70 of the contact terminal element 69, and then parallel to the longitudinal axis 70 up to a region in which the conductive element 68 is connected to the terminal contact 69. In this embodiment of the invention the conductive element 68 is an electric cable.

In an alternative embodiment of the invention the conductor guide 4 can be constructed straight with respect to the longitudinal axis 70 of the terminal contact 69. A conductive element is accordingly then guided parallel to the longitudinal axis of the terminal contact 69 in the interior of the conductor guide.

FIG. 5 shows the plug 1 in the assembled state, the supplementary part 3 being in the closed position in which it has arrived by insertion into the main housing 2. So that the supplementary part 3 could arrive in the closed position, the retaining profile 5 was positioned axially in the opening 66 at the level of the partial profile 6 and the supplementary profile 7. This ensures that the conductor guide 4 is fixed in the axially correct position.

If the retaining profile 5 had been inserted insufficiently far into the opening 66, the supplementary part 3 would not have been able to move into its closed position and the retaining profile 5 would not have engaged with the partial profile 6 and the supplementary profile 7. It should be noticeable to the installer that the assembly process of the movement of the supplementary part 3 into the closed position was incomplete. Axial fixing of the conductor guide 4 and testing its correct axial position therefore take place in one working step.

According to FIG. 5, the retaining profile 5 of the conductor guide 4 is in each case engaged with the partial profile 6 of the main housing 2 and the supplementary profile 7 of the supplementary part 3. The retaining profile 5 is accordingly located in the centre of the opening 66 formed by the partial profile 6 and the supplementary profile 7. In the closed position, the terminal contact axis 8 and the longitudinal axis 70 of the terminal contact 69 coincide. The latching structures 52, 53, 56, 57 of the supplementary part 3 are latched to the latching structures 27, 28, 29, 30 of the main housing 2.

In this embodiment of the invention only the partial profile 6 and the supplementary profile 7 are engaged with the retaining profile 5. In addition, a lower side 71 of the conductor guide 4 rests at certain sections on the upper side of the upper wall 13 of the main housing 2 and/or the upper side 49 of the supplementary part 3, depending on the rotational position of the conductor guide 4 relative to the main housing 2 and the supplementary part 3.

It can also be seen in FIG. 5 that, in comparison to the starting position, in the closed position of the supplementary part 3, the unit comprising retaining arm 45, latching profile 44 and actuating rocker 46 is located deeper in the receiving groove 35. The rocker beams 63, 64 of the actuating rocker 46 are thus in contact with the rocker support 39. Pressing the actuating portion 65 in the direction transverse with respect to the terminal contact axis 8 thus leads to rocking with rotation about a rocker axis defined by a point 72 of the rocker supporting part 39, in other words about a rocker axis defined by the rocker support 39. In the process, the actuating rocker 46 substantially retains its shape and determines the movement of the latching profile 44. This moves substantially in the direction transverse to the terminal contact axis away from the main housing 2. The retaining arm 45 resiliently deforms in the process and consequently applies restoring forces.

The actuating portion 65 is pivotally located in the swivelling space 60 close to the upper wall 13 and can therefore be easily reached and operated.

Despite the fact that the retaining profile 5 is engaged with the partial profile 6 and the supplementary profile 7 and that the conductor guide 4 is axially fixed, the conductor guide 4 remains rotatable about the terminal contact axis 8 as the retaining profile 5 is round and the partial profile 6 and the supplementary profile 7 are shaped like an arc of a circle so as to correspond therewith.

In this embodiment the terminal contact axis 8 then extends, when the supplementary part 3 is in the closed position, substantially parallel to a longitudinal axis of a cylindrical portion 73 of the conductor guide 4 on which the retaining profile 5 thereof is formed. In this embodiment, this longitudinal axis coincides with the longitudinal axis 70 of the terminal contact 69.

FIG. 6 shows the plug 1 according to the invention fully assembled in the state placed on a complementary mating plug connector and latched therewith. The latching profile 44 engages behind a latching hook 74 of the mating plug connector 11 in the process. The latching hook 74 extends in certain sections into the recess 37 of the main housing 2. With engagement of the latching profile 44 behind the latching hook 74, the plug connector 1 according to the invention is axially secured to the mating plug connector 11 with respect to the terminal contact axis 8.

Figure 1:
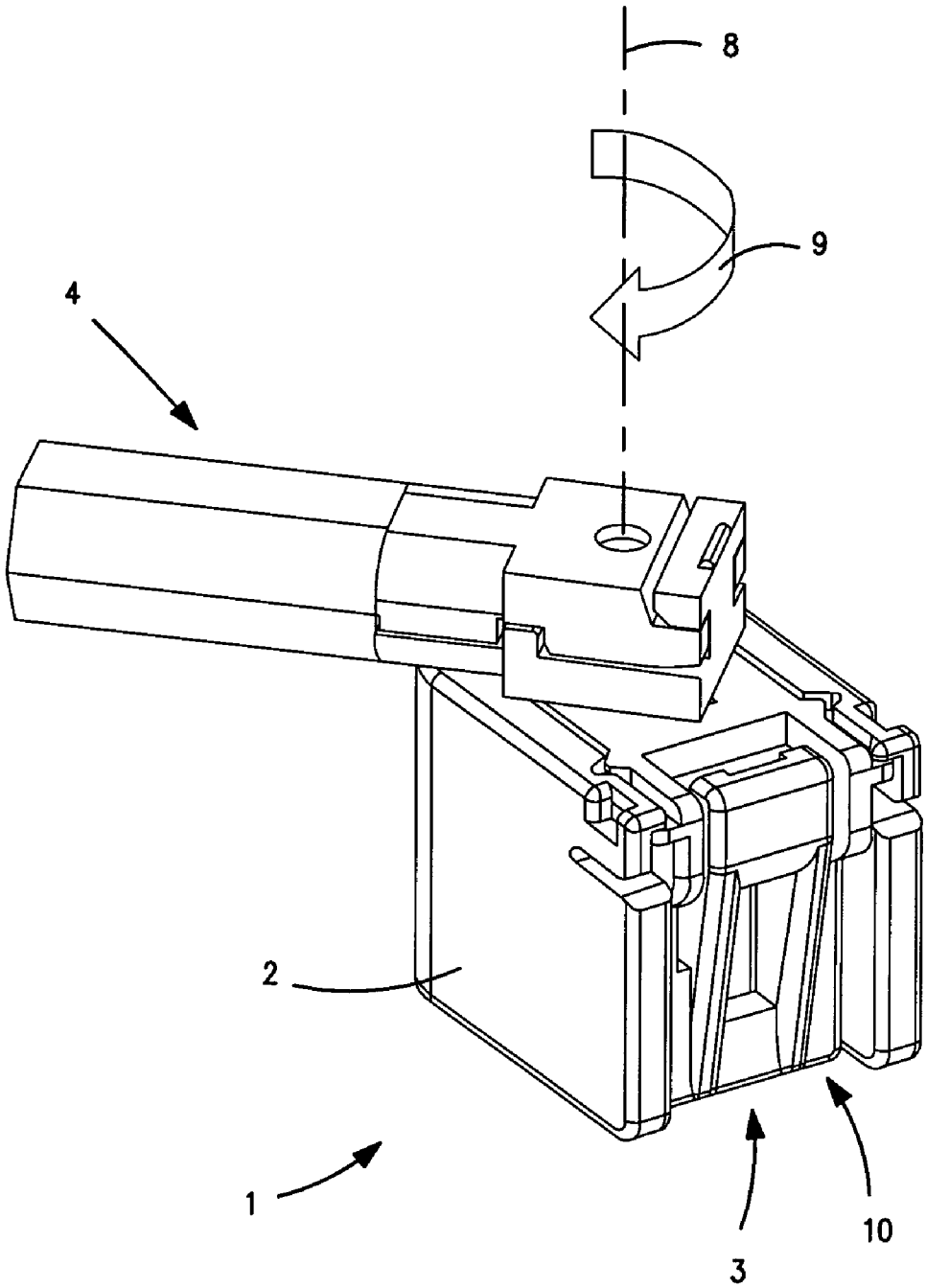
Figure 2:
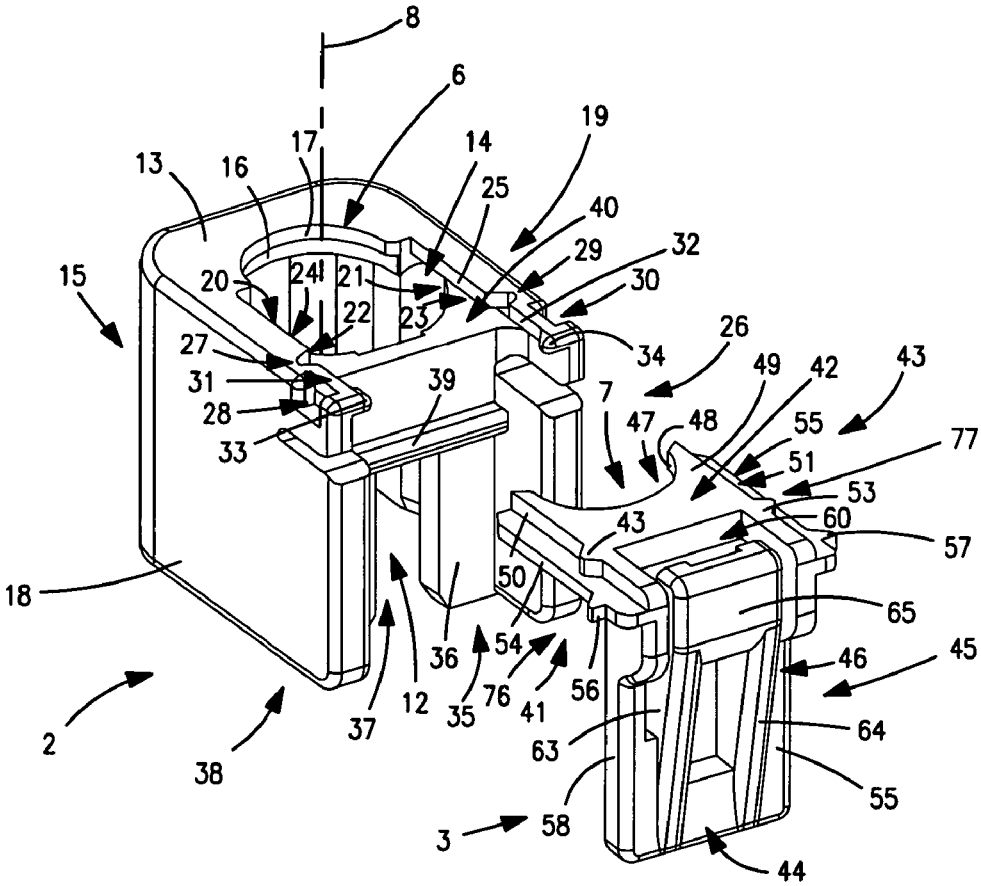
Figure 3:
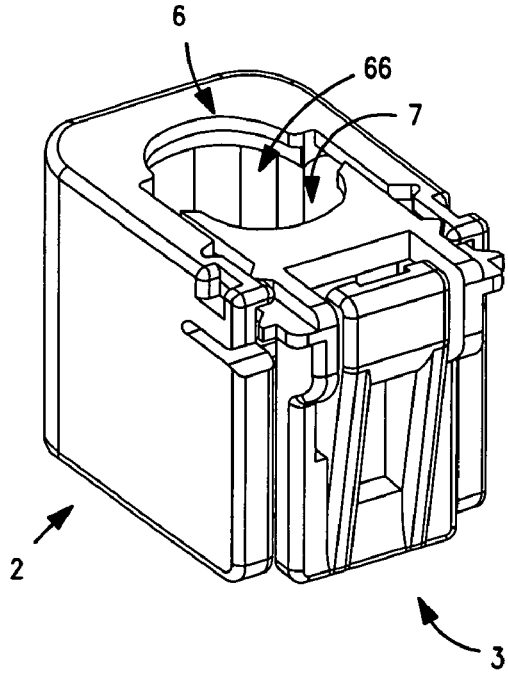
Figure 4:
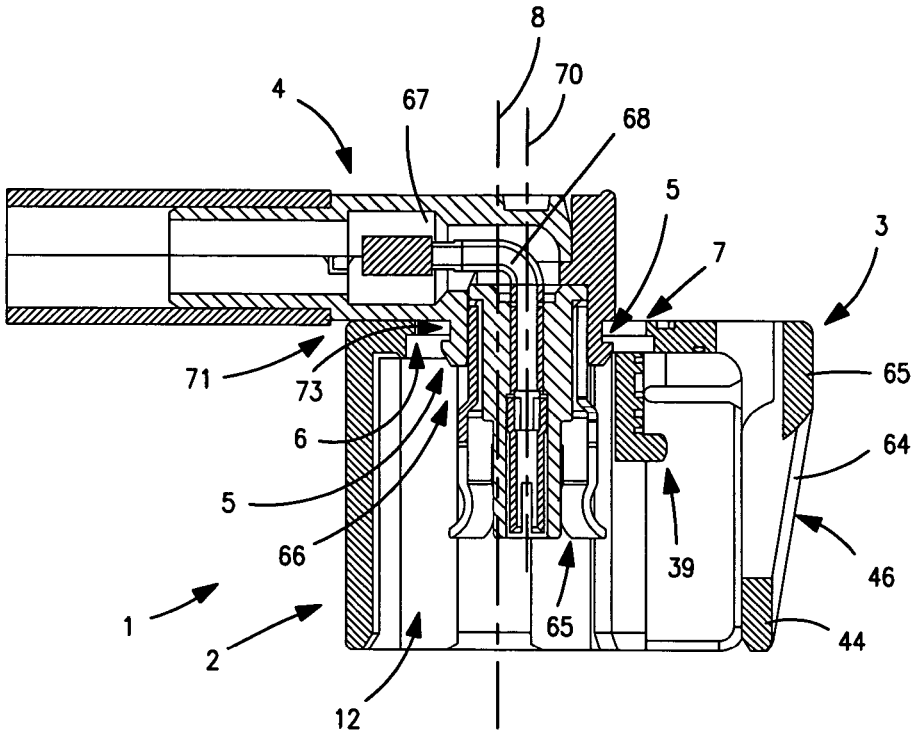
Figure 5:
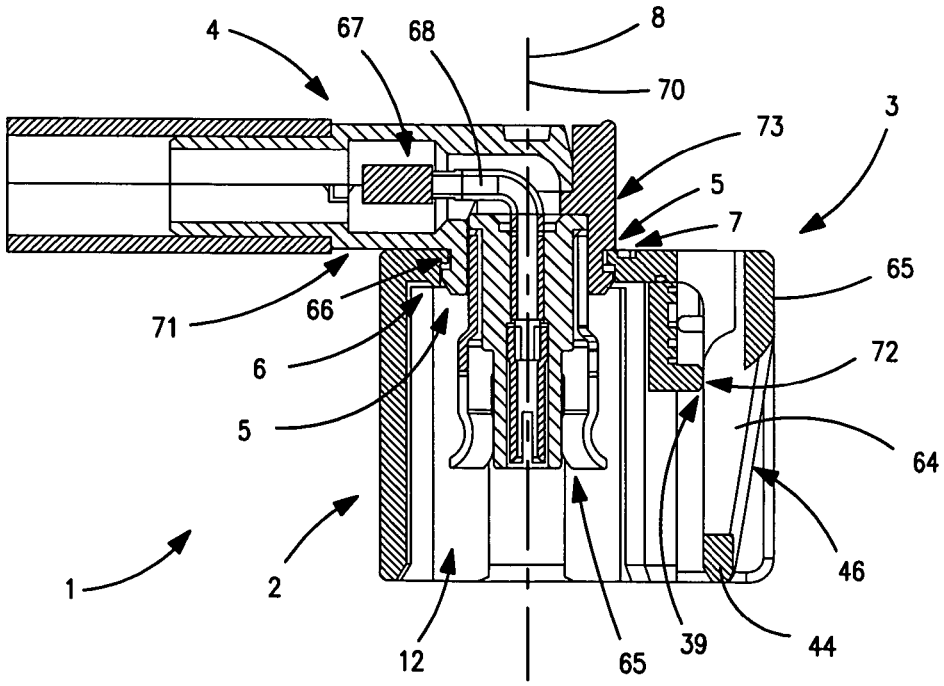
Figure 6:
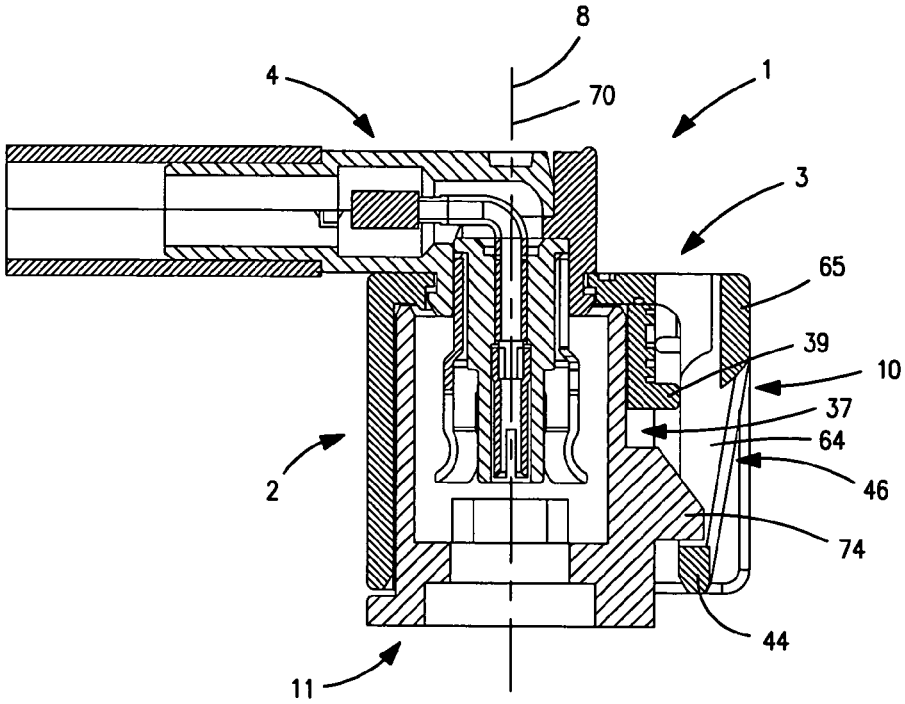
Figure 7:
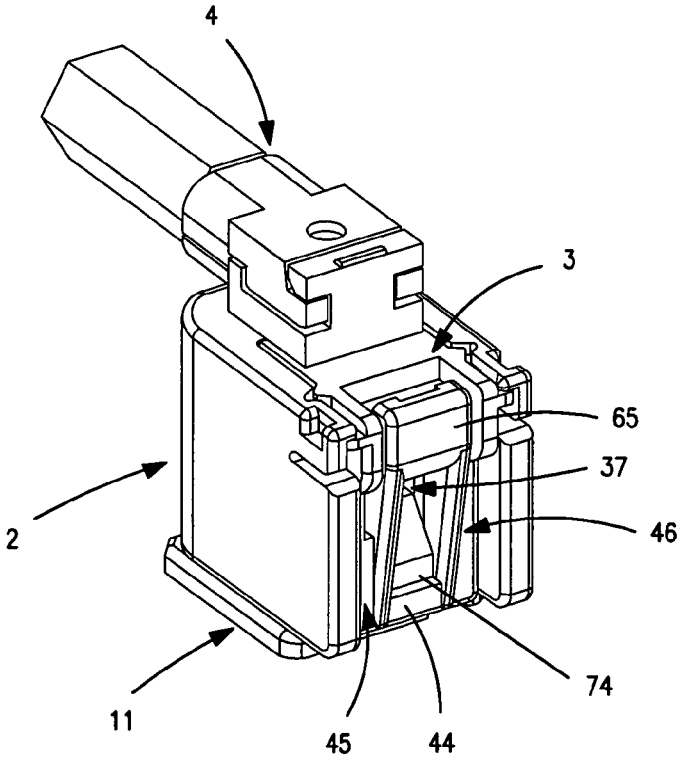
FIG. 7 shows the arrangement according to FIG. 6 in a perspective view.
Figure 8:
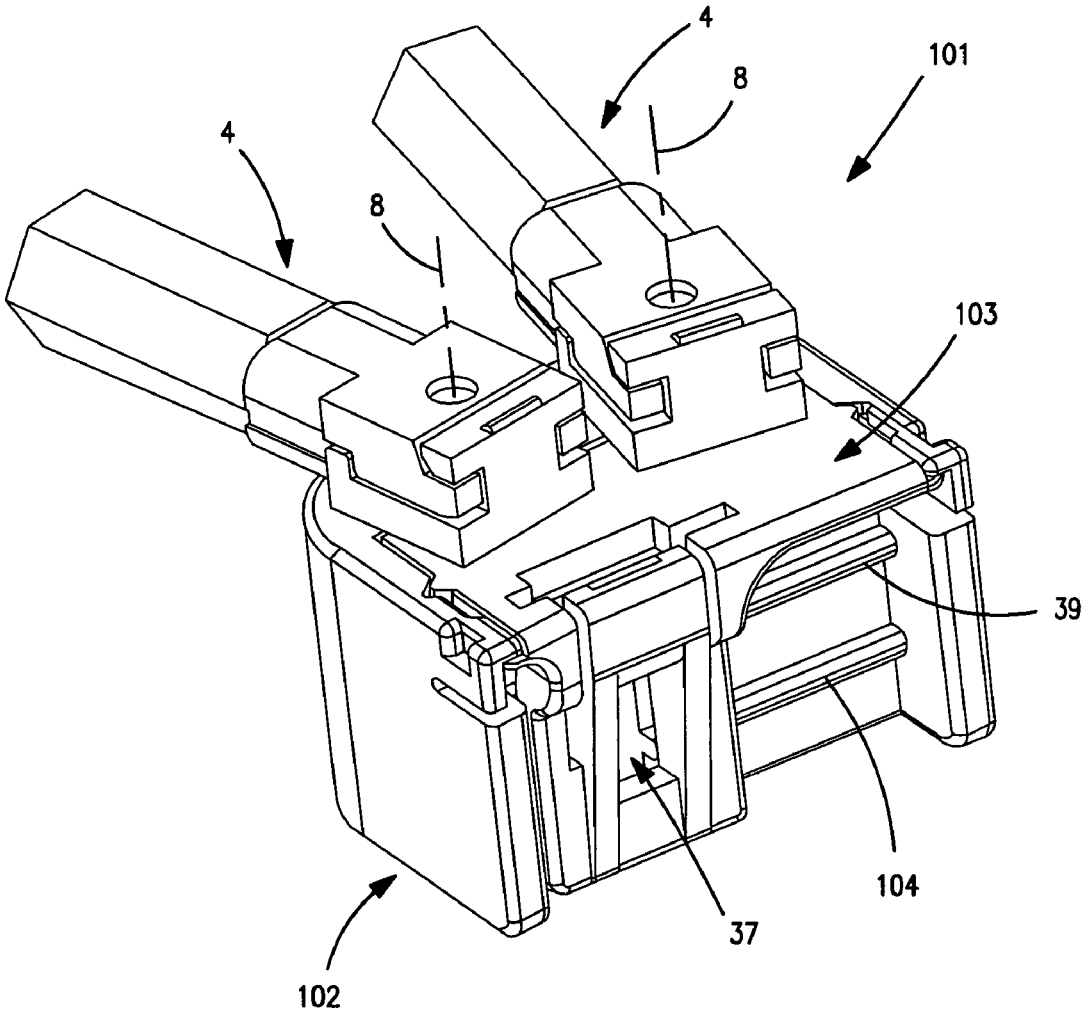
FIG. 8 shows a plug according to another embodiment of the invention. Identical reference numerals have been used for identical elements and reference is made to the foregoing description in this regard.

The plug connector 101 of the present embodiment of the invention, in contrast to the plug connector 1, comprises two identical conductor guides 4. To fix the conductor guides 4 axially with respect to the respective terminal contact axes 8, the plug comprises a main housing 102 with two analogous partial profiles 6. A supplementary part 103 of the plug connector 101 accordingly comprises two analogous supplementary profiles 7.

Figure 9:
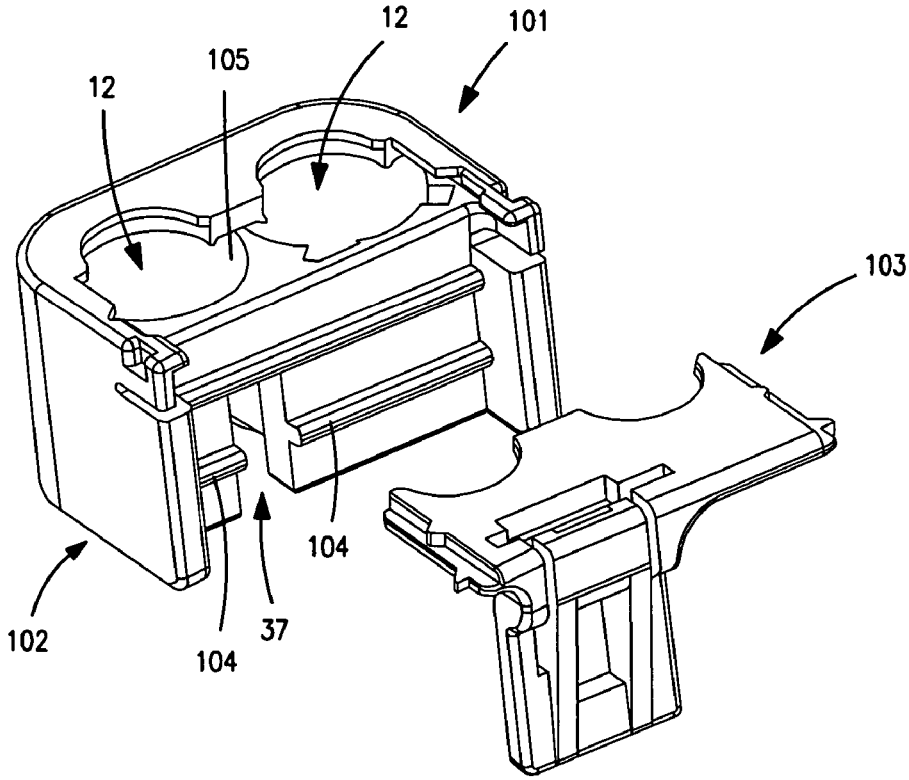
Figure 10:
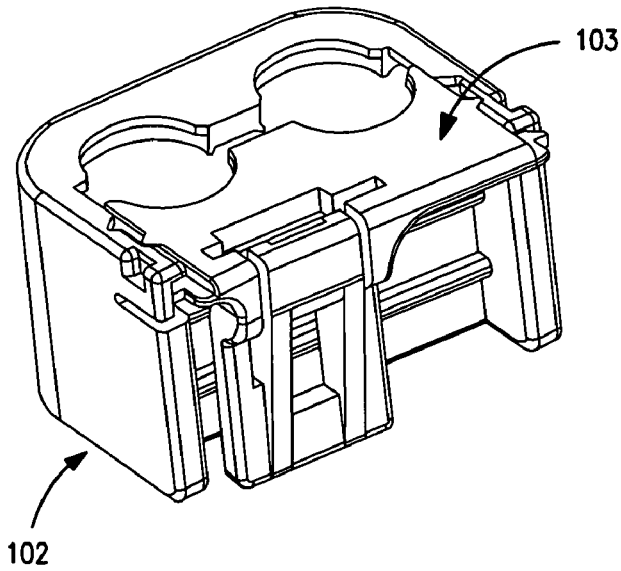

Irrespective of the fact that the main housing 102 and the supplementary part 103 are accordingly broader, they are each substantially analogous in construction to the main housing 2 and the supplementary part 3 of the previously described embodiment of the invention. However, the main housing 102 also has a reinforcing rib 104 extending substantially parallel to the rocker support 39 and interrupted by the recess 37 of the main housing 102. There is also a partition 105 between the receiving spaces 12, as can be seen in particular in FIG. 9. FIG. 9 shows the main housing 102 and the supplementary part 103 in the separated state while in the view of FIG. 10, the supplementary part 103 is in the starting position with respect to the main housing 102.

FIG. 11 to 14 show a plug connector 201 of yet another exemplary embodiment of the invention. Identical reference numerals are used for identical elements and reference is made to the foregoing descriptions.

Figure 11:
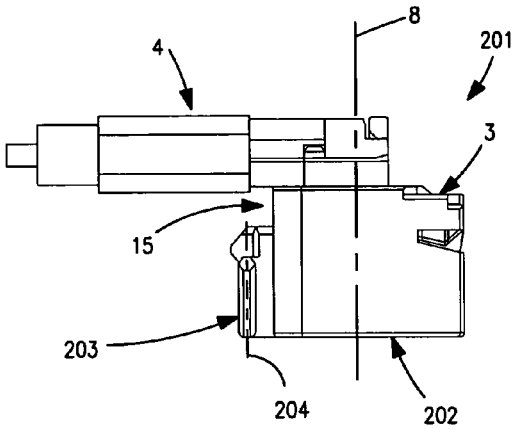
Figure 12:
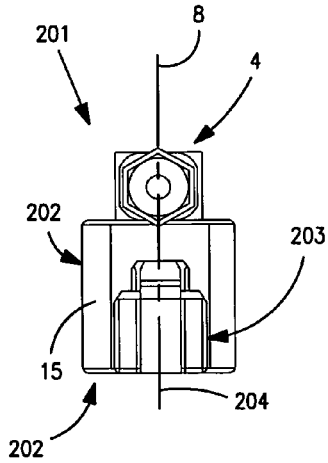

The plug connector 201, is similar to the plug connector 1 of the previously described embodiment of the invention, but also has a rotatable fixing device 210. As can be seen in FIG. 11, a substantially dovetailed guide 203 is arranged on the back wall 15 of a main housing 202 which is otherwise identical to the main housing 2 of the first described embodiment of the invention. A longitudinal direction 204 of the guide 203 extends parallel to the terminal contour axis 8, as can also be seen in the view of the back of the plug connector 201 in FIG. 12.

Figure 13:
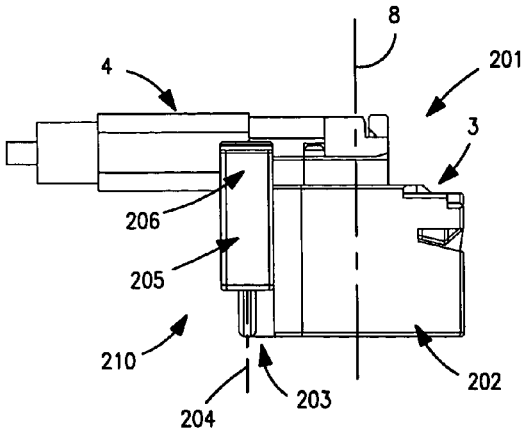
Figure 14:
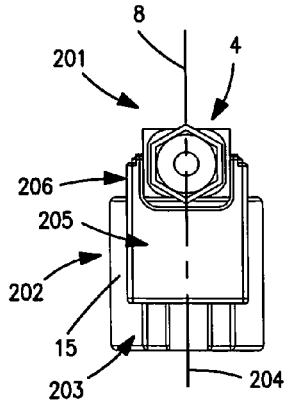

FIGS. 13 and 14 show a displaceable fork 205 of the rotatable fixing device 210 in the state pushed onto the guide 3. Here the fork 205 is in a locked position in which a fork section 206 of the fork 205 laterally surrounds the conductor guide 4 in certain sections. The fork 205 thus holds the conductor guide 4 in the specific position of rotation.

By moving the fork 205 in the longitudinal direction 204 of the guide 203, away from the conductor guide 204, the fork 205 arrives in a release position. The conductor guide 4 can be rotated about the terminal contact axis 8 again in this release position.

What is claimed is:

1. A plug connector comprising a main housing, at least one conductor guide, and a supplementary part, wherein the conductor guide comprises a retaining profile with which a partial profile of the main housing and a supplementary profile of the supplementary part can be brought, at least in certain sections, into engagement so as to correspond with each other, wherein the supplementary part can be moved relative to the main housing between a starting position and a closed position, and in the starting position the conductor guide can be positioned in an opening formed with the partial profile and the supplementary profile and is axially loosely movable and in the closed position, the conductor guide is rotatable and axially fixed relative to the main housing and the supplementary part owing to the engagement of the retaining profile with the partial profile and the supplementary profile.

2. Plug connector according to claim 1, wherein, in the closed position, the supplementary part is latched with the main housing.

3. Plug connector according to claim 1, wherein the supplementary part is movably guided on the main housing, via guide rails, between the starting position and the closed position.

4. Plug connector according to claim 3, wherein mutually corresponding latching structures are provided on the main housing and the supplementary part substantially in the region of the guide rails.

5. Plug connector according to claim 1, wherein a latching mechanism is provided with an actuating rocker with which the plug connector can be latched to a mating plug connector, a latching profile of the latching mechanism and the actuating rocker being formed on the supplementary part.

6. Plug connector according to claim 5, wherein a rocker support for the actuating rocker is provided on the main housing, the rocker support defining a rocker axis of the actuating rocker.

7. Plug connector according to claim 6, wherein, in the closed position of the supplementary part, the actuating rocker is in contact with the rocker support, and in the starting position of the supplementary part, the actuating rocker is spaced apart from the rocker support.

8. Plug connector according to claim 5, wherein the actuating rocker is connected in the region of the latching profile to a retaining arm, the retaining arm being provided on the supplementary part at an end opposing the latching profile.

9. Plug connector according to claim 8, wherein the retaining arm can be resiliently deformed while the actuating rocker is comparatively resistant to bending.

10. Plug connector according to claim 5, wherein, in the closed position of the supplementary part, an actuating section of the actuating rocker is arranged in the region of the end of the plug connector at which the conductor guide issues from the main housing.

11. Plug connector according to claim 1, wherein at least one rotatable fixing device is provided on the main housing or the supplementary part, with which device the conductor guide can be locked in a specific position of rotation.

12. Plug connector according to claim 11, wherein the rotatable fixing device can be moved between a release position in which the conductor guide can be rotated relative to the main housing and a locking position in which the conductor guide is locked in the specific position of rotation.

13. Plug connector according to claim 11, wherein a part of the rotational fixing device which can be brought into engagement with the conductor guide is configured substantially in the manner of a fork.

* * * * *